US006484651B1

(12) United States Patent
Shepard, Jr. et al.

(10) Patent No.: US 6,484,651 B1
(45) Date of Patent: Nov. 26, 2002

(54) METHOD FOR OPERATING A SLAG TAP COMBUSTION APPARATUS

(75) Inventors: Robert N. Shepard, Jr., Winfield, WV (US); Peter L. Rozelle, Forty Fort, PA (US)

(73) Assignee: Crown Coal & Coke Co., Pittsburgh, PA (US)

( * ) Notice: Subject to any disclaimer, the term of this patent is extended or adjusted under 35 U.S.C. 154(b) by 0 days.

(21) Appl. No.: 09/684,125

(22) Filed: Oct. 6, 2000

(51) Int. Cl.[7] ..... F23B 7/00

(52) U.S. Cl. ..... 110/342; 110/342; 110/345; 122/235.26

(58) Field of Search ..... 122/235.26, 4 D; 165/104.16; 110/218, 219, 234, 236, 263, 266, 341, 342, 343, 346, 347

(56) References Cited

U.S. PATENT DOCUMENTS

| | | | | |
|---|---|---|---|---|
| 2,844,112 A | * | 7/1958 | Muller | 110/1 |
| 3,004,836 A | * | 10/1961 | Thompson | 44/4 |
| 3,823,676 A | | 7/1974 | Cook et al. | |
| 4,173,454 A | | 11/1979 | Heins | |
| 4,372,227 A | * | 2/1983 | Mahoney et al. | 110/342 |
| 4,377,118 A | * | 3/1983 | Sadowski | 110/343 |
| 4,438,709 A | * | 3/1984 | Borio et al. | 110/347 |
| 4,514,256 A | | 4/1985 | Kober et al. | |
| 4,572,085 A | * | 2/1986 | Hepworth | 110/345 |
| 4,577,566 A | | 3/1986 | Merrell | |
| 4,668,429 A | * | 5/1987 | Najjar | 252/373 |
| 4,671,804 A | | 6/1987 | Najjar | |
| 4,706,579 A | * | 11/1987 | Merrell | 110/343 |
| 4,741,278 A | * | 5/1988 | Franke et al. | 110/342 |
| 4,765,258 A | * | 8/1988 | Zauderer | 110/347 |
| 4,784,670 A | * | 11/1988 | Najjar | 48/197 R |

(List continued on next page.)

FOREIGN PATENT DOCUMENTS

| | | |
|---|---|---|
| JP | 11094234 | 4/1999 |
| WO | WO 86/04602 | 8/1986 |

OTHER PUBLICATIONS

*Steam* by The Babcock and Wilcox Company, 1972, chapter 15, pp. 15–1 to 15–26, Published in the United States of America.

*Primary Examiner*—Ira S. Lazarus
*Assistant Examiner*—K. B. Rinehart
(74) *Attorney, Agent, or Firm*—Kirkpatrick & Lockhart LLP

(57) ABSTRACT

The present invention provides a method of operating a solid fuel fired boiler comprising introducing a solid fuel and an iron-bearing material into the boiler. The solid fuel is at least partially combusted in the boiler to produce an ash slag, wherein the ash fusion temperature characteristics (i.e., one or more of the IDT, ST, HT, and FT) of the ash slag are different than the ash fusion temperature characteristics of the ash slag that would result on combustion of the solid fuel alone. The method of the present invention is particularly applicable to slag tap boilers, including cyclone-type boilers. These boilers are, typically, designed to operate with a liquid ash slag.

The iron-bearing material may be, but is not limited to, at least one of iron ore beneficiation tailings, iron ore fines, pelletized blends of coal and iron-bearing material, pelletized solid fuel containing iron-bearing compounds, iron-bearing boiler ash, mill scale from steel production, dust from blast furnace gas cleaning equipment, flue dust from sinter plants, and other materials including iron or including material that bears iron. According to the present invention also describes methods of introducing the iron-bearing material into the slag tap combustion apparatus. The method of the invention allows lower sulfur coals, as well as other fuels typically unsuited for use in slag top boilers, to be used in such boilers, significantly reducing $SO_2$ emissions.

26 Claims, 5 Drawing Sheets

U.S. PATENT DOCUMENTS 4,796,548 A * 1/1989 Merrell et al. ..... 110/343
4,831,942 A * 5/1989 Moritomo et al. ..... 110/345
4,843,980 A 7/1989 Markham et al.
5,001,994 A * 3/1991 Moritomo ..... 110/342
5,207,164 A * 5/1993 Breen et al. ..... 110/345
5,282,430 A * 2/1994 Nehls, Jr. ..... 110/345
5,320,051 A * 6/1994 Nehls, Jr. ..... 110/345
5,324,336 A * 6/1994 Child ..... 44/608
5,333,558 A 8/1994 Lees
5,364,421 A 11/1994 Westby et al.
5,819,672 A * 10/1998 Radway et al. ..... 110/344
5,888,256 A * 3/1999 Morrison ..... 44/552
5,894,806 A 4/1999 Smyrniotis et al.
5,899,678 A 5/1999 Thomson et al.

* cited by examiner

METHOD FOR OPERATING A SLAG TAP COMBUSTION APPARATUS

CROSS-REFERENCE TO RELATED APPLICATIONS

Not Applicable

FEDERALLY SPONSORED RESEARCH

Not Applicable

TECHNICAL FIELD AND INDUSTRIAL APPLICABILITY OF THE INVENTION

The present invention is directed to the operation of slag tap-type combustion apparatuses for the production of steam, generation of electric power, or for any other purpose. Application of the present invention to solid fuel-fired slag tap-type boilers will allow a reduction in noxious emissions of these boilers. More particularly, the present invention is directed to the addition of iron-bearing compounds to solid fuel-fired slag tap-type boilers for the purpose of fluxing the ash of fuels that would otherwise produce ash slag with high ash fusion temperatures and/or high viscosity, or that would otherwise be incompatible, for environmental or other reasons, with such boilers. As described in detail below, many different industrial products and by-products may be used as the iron-bearing compounds utilized in the method of the present invention. The method of the present invention may be used in heat, steam, and power production, and in any other applications of solid fuel-fired slag tap-type boilers.

BACKGROUND OF THE INVENTION

The combustion of solid fuel releases energy that may be harnessed for the production of heat, steam, electricity, or for other purposes. Solid fuels presently combusted for the production of heat, steam, electricity, or other purposes include, but are not limited to, coal, biomass, petroleum coke, and other synthetic fuels. The most widely used solid fuel for electricity generation is coal. Coal is a macromolecular network composed of groups of polynuclear aromatic rings, to which are attached subordinate rings connected by oxygen, sulfur, and aliphatic bridges. Combustion of the organic matter of the macromolecular network generates heat that typically is used to generate steam that drives steam turbines and generates electricity. Along with the generation of heat, combustion of coal produces flue gases and fuel ash slag. The ash slag generally consists of the mineral matter remaining after combustion of the organic matter in the coal. Thus, the slag may include, for example, silicas, aluminas, iron oxides and other inorganic compounds.

Coal is abundant in the United States, more abundant than oil, for example, and coals from different regions of the United States and the world have different characteristics, such as chemical composition, heat value, and physical properties. Much of the coal from the eastern region of the United States has a high sulfur content and when combusted produces an ash that can be handled as a liquid at conventional combustion chamber temperatures. Conversely, low sulfur coal from the eastern region of the United States produces an ash that cannot be handled as a liquid at these temperatures, due to elevated melting temperatures. Handling low-sulfur coal from the western United States may present handling problems similar to those encountered with eastern region low sulfur coals, or they may present operational difficulties due to unfavorable slag viscosity characteristics.

Certain boiler systems that are fired with solid fuels, and more particularly fired with coal, are designed to operate with a continuous flow of liquid fuel ash or "slag" out of the bottom region of the boiler. Boilers of this type are variously referred to as "slag tap" or "wet bottom" boilers. The operation of these boilers is limited to coals that combustion produce an ash slag having a low ash fusion temperature (AFT), low viscosity, or other characteristic that allows the ash slag to flow from the combustion chamber of the boiler during operation of the boiler. The ash fusion temperature properties of the resultant fuel ash slag may be characterized in a number of ways, including initial deformation temperature (IDT), softening temperature (ST), hemispherical temperature (HT), and fluid temperature (FT). The AFT properties are commonly determined by the procedure outlined in ASTM Standard D-1857. This procedure defines the IDT as the temperature at which the first rounding of the tip of a cone formed from the ash of the coal being evaluated occurs; the ST is defined as the temperature at which the cone has fused down to a spherical lump having a height equal to the width of the base; the HT is defined as the temperature at which the cone has fused down to a hemispherical lump having a height which is one half the width of the base; and the FT is defined as the temperature at which the fused mass has spread out in a nearly flat layer with a maximum height of one sixteenth of an inch. In this specification, these temperatures are collectively referred to as the Ash Fusion Temperature or AFT characteristics of a particular ash.

Slag tap boilers fall into two general categories, both requiring production of a liquid ash slag from combustion of the solid fuel to operate properly. The first category is characterized by boilers that fire the fuel in pulverized form. Such boilers are referred to herein as "pulverized fuel" boilers. The second category includes boilers commonly referred to as cyclone boilers. In a cyclone boiler, crushed coal is fed into the burner end of a water cooled, horizontally oriented cylinder. Combustion air is introduced into the cylinder tangentially to impart a whirling motion to the coal. Coal fired boilers in both of these broad categories require the use of coal that produces an ash with properties characteristic of low AFT and favorable viscosity properties over the temperature range experienced in the combustion environment. Such AFT and viscosity properties are necessary to allow the ash slag to flow from the boiler. Typically, coals and other fuels with the low AFT characteristics or favorable ash viscosity properties required for use in slag tap boilers also have high sulfur concentrations. High sulfur content coals and other fuels produce greater sulfur dioxide and noxious gases when combusted in fuel-fired boilers.

Slag tap boilers are typically individually designed to bum coal from the local area. Therefore, the combustion chamber is designed to operate with the particular ash produced from a certain coal type. Conversely, coal meeting certain predetermined specifications must be used in each slag type boiler to ensure proper operation. These specifications include, but are not limited to, specifications for AFT characteristics, ash slag viscosity temperature profile range, ash slag base-to-acid ratio, as well as others. Coals which do not meet the specifications engineered into a certain designer's slag tap boiler cannot be used in the boiler.

Phase I of the Acid Rain Program of the 1990 Clean Air Act placed a limit on the amount of sulfur dioxide ($SO_2$) that can be emitted annually by certain sources. $SO_2$ emissions from coal fired electric utility plants located in the eastern and midwestern states were typically limited to a greater degree than other sources. Sources of $SO_2$ air pollution are allocated allowances, or "rights to pollute", based on their historic level of $SO_2$ emissions. Each allowance permits one ton of $SO_2$ to be released into the air and cannot be used again. At the end of each year, polluting sources must hold enough allowances to cover their $SO_2$ emissions for that year. Any remaining allowances can be sold, traded, or banked for future use. If a source of air pollution does not have enough allowances to cover its $SO_2$ emissions, it can buy allowances on the open market. Every year the limit on the amount of $SO_2$ that can be emitted annually is reduced. Allowances are, therefore, a valuable commodity and emissions of $SO_2$ are becoming more expensive every year. Phase II of the Acid Rain Program, which began in the year 2000, further tightens the annual $SO_2$ emission limits imposed on coal fired utilities and on smaller, cleaner burning plants.

Therefore, burning of high sulfur coals has become or will shortly become cost prohibitive for many electric or steam generation facilities. Since slag tap or cyclone boilers were designed to operate using high sulfur coals with low AFT characteristics, continued operation of these facilities using high sulfur coals and conventional power production methods will continue to become increasingly costly, to producers and consumers alike. Lower sulfur coals generally have ash chemistry and AFT characteristics that are outside the range for which these boilers were originally designed and, therefore, use of these alternate fuels can cause significant operational problems. For example, lower sulfur coals typically have higher AFT characteristics (i.e., higher IDT, ST, HT, and FT) and, therefore, the resultant fuel ash may not flow from the bottom of the boiler, a requisite with slag tap boilers.

In order to address the problems associated with the use of alternate coal types in slag type boilers, attempts have been made to modify the AFT characteristics of coals. For example, U.S. Pat. No. 5,364,421 describes a process wherein bituminous coal, which is unsuitable for use in slag tap boilers, is blended with lignitic coal. The blend is adjusted such that the resultant fuel ash has a viscosity at or below 250 poise at 2600° F., the operating temperature of the combustion chamber. The '429 patent states that coals having ash viscosity in this range are suitable for use in slag tap boilers. However, the technique of blending coals to adjust AFT characteristics has major limitations because the amount of high sulfur coal that can be blended with low sulfur coal and still operate with the sulfur emissions regulations is limited. Also, the blending of coals has only a limited effect on the properties of the ash slag. Therefore, this method has limited industrial applicability.

Thus, there exists a need for a method of modifying the operation of solid fuel-fired slag tap boilers to allow the boilers to operate with alternate fuels for which the boilers were not designed. There also exists a need for a method of altering the AFT characteristics of low sulfur coals to render them suitable for use in certain slag tap boilers.

In addition, there exists a need for a method of maintaining stable boiler operation when operating slag tap boilers with solid fuels that would produce ash slag with AFT characteristics outside the range for which the boilers were originally designed.

SUMMARY OF THE INVENTION

The present invention provides a method of operating a solid fuel fired boiler comprising introducing a solid fuel and an iron-bearing material into the boiler. The solid fuel is at least partially combusted in the boiler to produce an ash slag, wherein the ash fusion temperature characteristics (i.e., one or more of the IDT, ST, HT, and FT) of the ash slag are different than the ash fusion temperature characteristics of the ash slag that would result on combustion of the solid fuel alone. The method of the present invention is particularly applicable to slag tap boilers, including cyclone-type boilers. These boilers are, typically, designed to operate with a liquid ash slag.

The iron-bearing material may be, but is not limited to, at least one of iron ore beneficiation tailings, iron ore fines, pelletized blends of coal and iron-bearing material, pelletized solid fuel containing iron-bearing compounds, iron-bearing boiler ash, mill scale from steel production, dust from blast furnace gas cleaning equipment, flue dust from sinter plants, and other materials including iron or including material that bears iron. The iron-bearing material may be blended with the coal or other solid fuel that is to be fired in the boiler prior to or during combustion to modify one or more properties of the ash slag to meet the design specifications of the boiler. These properties may be, but are not limited to, ash fusion temperature characteristics, ash slag viscosity, ash slag base-to-acid ratio, as well as other properties.

According to the present invention, the iron-bearing material may be fed into the slag tap or other solid fuel fired boiler in one or more of several different locations. In pulverized fuel slag tap boilers, the material bearing iron compounds may be fed into, for example, the fuel pulverizers, the fuel transfer system, directly into the boilers, into the combustion chamber enclosure or any other location in the system. In cyclone slag tap boilers, the iron-bearing material may be fed into, for example, the fuel storage bunker, the fuel transfer system, the cyclone boilers directly, the combustion enclosure, or any other location in the system.

The method of the invention allows lower sulfur coals, as well as other fuels typically unsuited for use in slag top boilers, to be used in such boilers, significantly reducing $SO_2$ emissions.

The reader will appreciate the foregoing details and advantages of the present invention, as well as others, upon consideration of the following detailed description of embodiments of the invention. The reader also may comprehend such additional details and advantages of the present invention upon making and/or using the stainless steels of the present invention.

BRIEF DESCRIPTION OF THE DRAWINGS

The features and advantages of the present invention may be better understood by reference to the accompanying drawings, in which.

DETAILED DESCRIPTION OF EMBODIMENTS OF THE INVENTION

Figure 1:
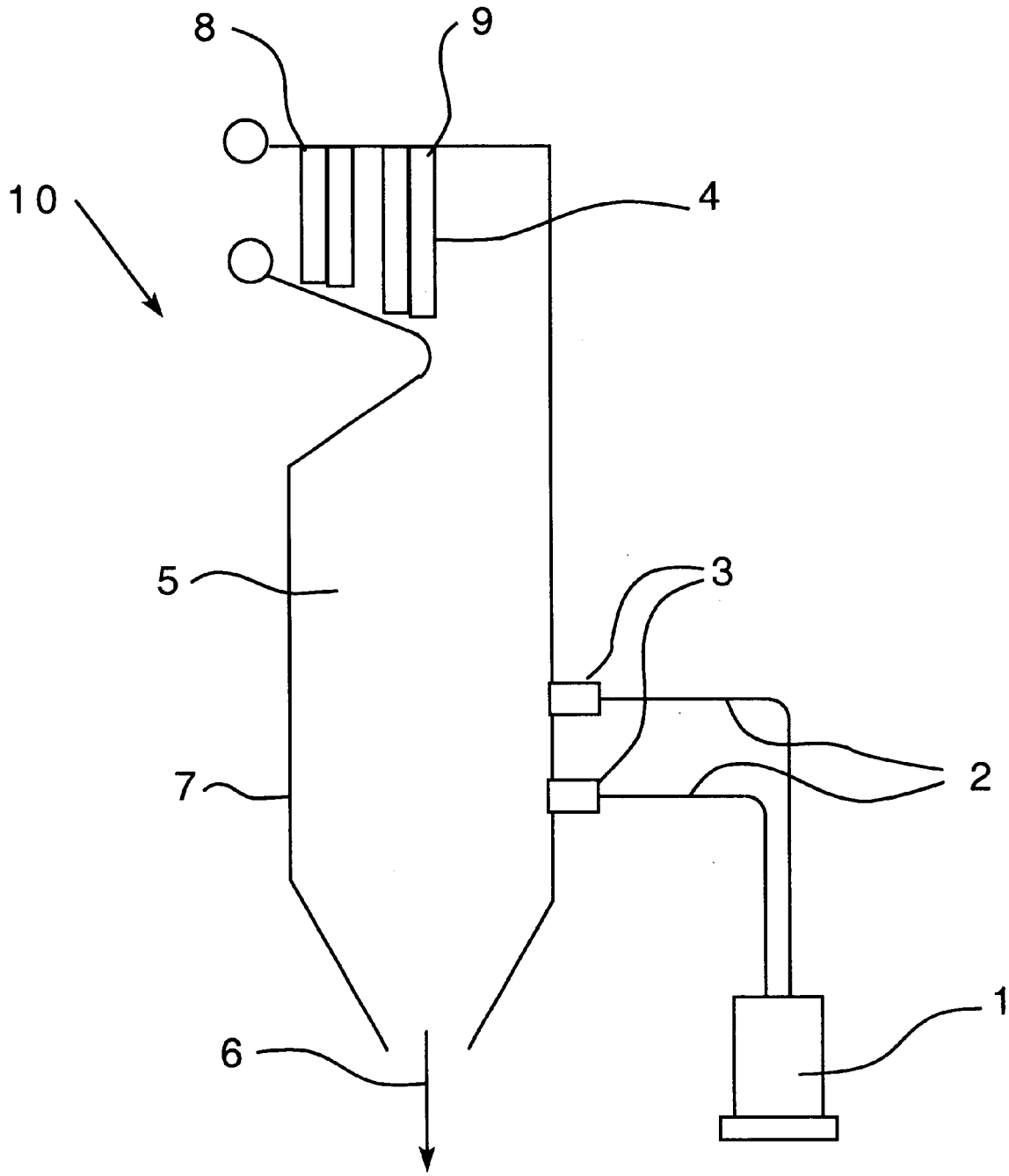
FIG. 1 depicts a conventional coal-fired pulverized fuel slag tap boiler installation that may be modified to implement the method of the present invention.

A conventional pulverized coal slag tap boiler is schematically depicted in FIG. 1 and is generally indicated as 10. Fuel may be fed to pulverizers 1, where the fuel is reduced in particle size. After pulverization, the fuel is transported, along with pulverizer gases, through fuel transfer system 2 to burners 3, where it is introduced to combustion chamber 5. In combustion chamber 5 the combustible portion of the fuel is largely consumed to produce heat, while the non-combustible portion of the fuel undergoes complex chemical transformations forming a fuel ash. The majority of the non-combustible portion of the fuel in a slag tap boiler should form ash slag in its liquid or molten state at the temperatures within the boiler. The solid portion of the fuel ash is generally called flue ash and should be entrained in the combustion gases.

Combustion chamber 5 of slag tap boiler 10 is enclosed, as is conventional, either partly or fully by heat transfer surface 7 which also is referred to as a waterwall. Waterwall 7 absorbs heat produced by combustion of the fuel in combustion chamber 5. Waterwall 7 typically contains a continuous feed of water which is converted to steam by heat generated in combustion chamber 5 for use in electric power generation or other uses.

The liquid or molten portion of the fuel ash in pulverized coal slag tap boiler 10 exits combustion chamber 5 through slag tap 6, while the remaining ash is entrained in combustion chamber gases fed to combustion chamber outlet 4. At combustion chamber outlet 4, the gases enter a passageway typically containing gas heat transfer surfaces 8 to recover the heat contained in the hot combustion chamber gases. In some cases a "slag screen" 9 may be mounted ahead of heat transfer surfaces 8, on which any ash particles entrained in the combustion gases may be collected and maintained in combustion chamber 5 as a slag. Slag screen 9 may reduce the potential deposition and fouling of heat transfer surfaces 8. Fouling of heat transfer surfaces 8 ultimately reduces the efficiency of boiler operation. If operation of the boiler becomes too inefficient, the boiler must be shut down and cleaned, which is costly, time-consuming, and takes the boiler out of service.

To maintain the necessary fuel ash slag flow from the slag tap 6 at the bottom of boiler 10, it is required that the AFT characteristics (i.e., IDT, ST, HT, and FT) of the ash be sufficiently low. In the case of boilers equipped with slag screens 9, it is also generally required that the AFT characteristics be sufficiently low as to prevent formation of slag screen deposits and screen pluggage, which would restrict the flow of combustion gases from combustion chamber 5.

Slag tap boilers are designed for the use of fuel with ash fusion temperatures below about 2600° F. Where fuel ash fusion temperatures are excessively high, the following operational difficulties may be encountered in the operation for slag tap boilers. First, ash slag with higher viscosity at combustion temperatures than the design viscosity of the boiler may result in poor ash flow properties under boiler operating conditions. This will stop slag flow out of the slag tap boiler and disrupt boiler operation. Second, the poor flow properties of slag produced from ash having elevated fusion temperatures can produce buildup of slag in the combustion chamber, notably on heat transfer surfaces. This may result in reduced steam production by the boiler, as well as possible premature mechanical failure of boiler components. Third, where a slag screen 9 is installed, buildup of slag ash with poor flow properties on the screen can result in restrictions of the flow of combustion gases out of the boiler, causing reduction in steam production, and possibly a complete blockage of combustion gas flow.

Figure 2:
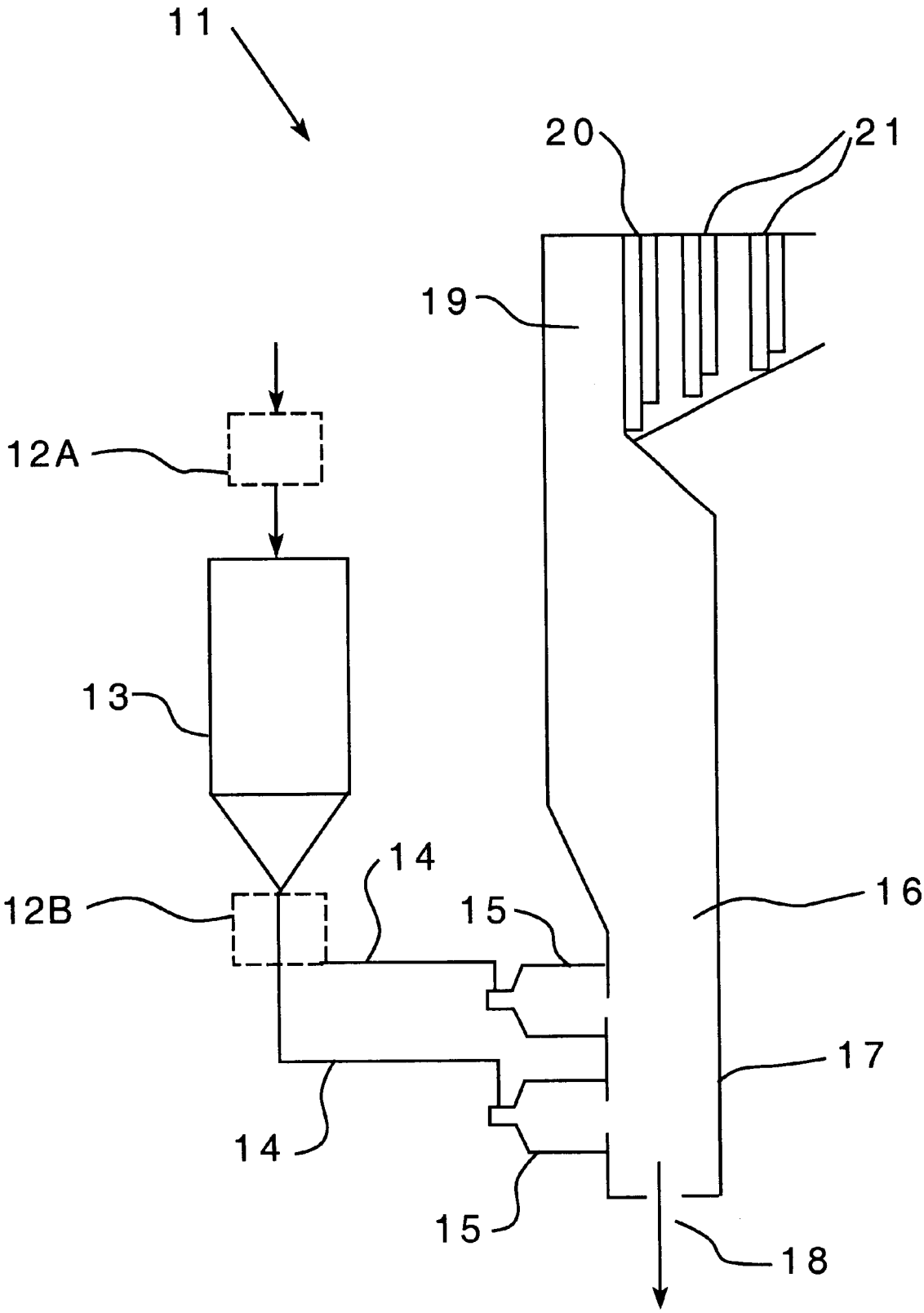
FIG. 2 schematically depicts a conventional cyclone boiler installation that may be modified to implement the method of the present invention.

The second category of slag tap boiler is the cyclone boiler system. A conventional cyclone furnace is shown schematically in FIG. 2 and is generally indicated as 11. Cyclone boiler 11 combusts a pulverized fuel to produce heat. Fuel is crushed in crusher 12A or 12B, typically so that approximately 95% of the fuel will pass through a 4-mesh screen. The fuel may be crushed to the desired particle size in crusher 12A prior to its introduction to the fuel storage bunker 13, or as it is fed from bunker 12B through transfer system 14. Cyclone boiler 11 has two water-cooled horizontal cylindrical cyclone burners 15 in which the fuel is fired and from which heat is released at extremely high rates. Approximately 20% of the combustion air enters burners 15 tangentially to impart a whirling motion to the incoming solid fuel. The remaining combustion air is admitted in the same direction tangentially at the roof of the cylinder of cyclone burners 15 and imparts further whirling or centrifugal action to the fuel particles. The operating temperature of combustion chamber 16 is typically designed to exceed 3000° F. (16500° C.). Coals are used in cyclone boilers that produce a liquid ash at these temperatures. The liquid ash forms a layer on the walls of cyclone burners 15. Some incoming coal particles are thrown to these walls by centrifugal forces, held in the slag, and scrubbed by the combustion air. Fuel and liquid slag are maintained in cyclone burners 15. Fuel is partially combusted in cyclone burners 15, and the balance of combustion is achieved as materials leave cyclone burners 15 and enter main combustion chamber 16, which is wholly of partly enclosed by waterwalls 17.

The molten slag in excess of the thin layer retained on waterwalls 17 continually drains away from the burner end of combustion chamber 16, discharges through slag tap 18 opening adjacent to lower cyclone burner 15, and is tapped into a slag tank, where the slag is solidified for disposal. The gaseous products of combustion are discharged into a gas-cooling portion of boiler 11. A portion or the fuel ash is entrained in the gaseous products and exits through combustion chamber outlet 19. Slag screen 20 may be mounted in this region to inhibit slag buildup on combustion gas heat exchange surfaces 21 due to entrained solids 11. Cyclone boilers are designed for fuels with low ash fusion temperatures (IDT, ST, HT, and FT) below about 2600° F. Where fuel with excessive ash fusion temperatures is used, the following operating difficulties can result. First, it may be difficult to maintain the flow of slag out of cyclone burners 15 and boiler slag tap 18. Second, slag buildup in main combustion chamber 16 may be difficult to remove from waterwalls 17, and this may result in mechanical failure of heat transfer surfaces 17 and 21.

Liquid coal ash can feasibly be removed from slag tap boilers if the slag ash has a viscosity of 250 poise or below at the operating temperature of the boiler. Slag tap boilers are typically designed for liquid coal ashes having a viscosity of 250 poise or less at 2600° F. Therefore, coals are usually classified by their $T_{250}$, which is the temperature in degrees Fahrenheit to obtain a 250 poise ash viscosity after combustion. The viscosity of coal fuel ash is typically measured in a high temperature rotating-bob viscometer. The direct measurement of the viscosity of coal ash in this way at several temperatures provides reliable data that can be used to determine the suitability of various coals for use in slag tap type boilers. However, since the direct measurement of coal ash viscosity by a viscometer is a long and costly procedure, methods of estimating the coal ash viscosity or $T_{250}$ from a chemical analysis of the coal ash have been developed.

Solid fuels, and particularly fossil fuels such as coal, used in steam generation may contain varying amounts of non-combustible constituents which, following the combustion process, are removed from the system in either a solid form, a liquid form, or both, as discussed above. Broadly, there are two sets of non-combustible chemical constituents of coal whose relative presence in the ash will influence AFT characteristics. These constituents of coal can be generally classified as either basic or acidic. The acidic constituents of coal typically are considered to be $SiO_2$, $Al_2O_3$, and $TiO_2$. The basic constituents typically are considered to be $Fe_2O_3$, CaO, MgO, $Na_2O$, and $K_2O$. Empirical studies have shown that the relative ratio of the basic to acidic constituents in the ash can be used to estimate the viscosity/temperature relationship of the fuel ash, including the silica ratio, the base-to-acid ratio, and the dolomite percentage. A higher ratio of basic constituents indicates lower AFT characteristics (i.e. lower IDT, ST, HT, and FT) of a fuel, and therefore, the basic constituents are considered to be the fluxes. The base-to-acid ratio is calculated by the following equation:

$$\text{Base-to-Acid Ratio} = \frac{Fe_2O_3 + CaO + MgO + Na_2O + K_2O}{SiO_2 + Al_2O_3 + TiO_2}$$

Figure 3:
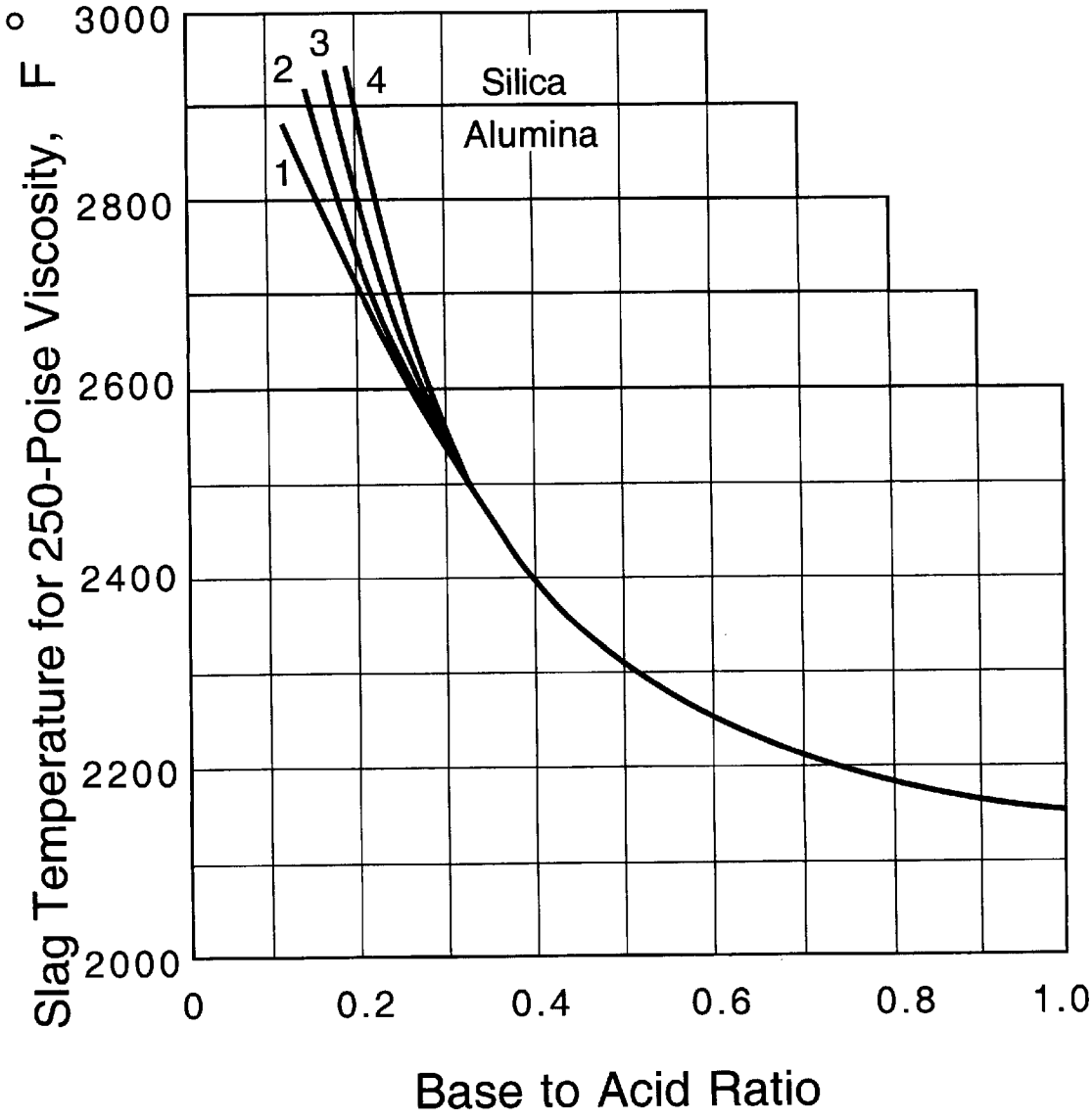
FIG. 3 is a graphical plot of temperature for 250-poise viscosity vs. base-to-acid ratio based on a ferric percentage of 20 utilized for estimating the $T_{250}$ of a coal from the composition of the ash.

FIG. 3 is a plot of temperature for 250-poise viscosity vs. the base-to-acid ratio based on a ferric percentage of 20 utilized for estimating the $T_{250}$ of a coal from the composition of the ash. The base-to-acid ratio is determined for an individual coal from the above equation, and the plot in FIG. 3 may be used to estimate the $T_{250}$ of the coal and, therefore, its suitability for use in a slag tap boiler.

Fuels can also be considered to have bituminous-type ash or lignite-type ash. For bituminous-type ash the principle flux, or viscosity lowering, component is $Fe_2O_3$, while for lignite-type ash the principle fluxes are CaO and MgO, and some lignitic ashes may also contain elevated levels of $Na_2O$, and $K_2O$. Fuels with bituminous-type ash, which have low AFT characteristics due to elevated $Fe_2O_3$ contents, typically derive the iron oxides from pyrite in the fuel, and are also characterized by high pyretic sulfur contents and, hence, high sulfur dioxide emissions potential. Switching to lower sulfur fuels will cause fuel ash with lower iron contents and lower basicity to be produced in the furnace, resulting in the aforementioned slag and ash handling problems due to higher than design ash viscosity characteristics.

In one aspect, the present invention is directed to the addition of iron-bearing materials in conjunction with low sulfur solid fuels that would generally be considered unsuitable for combustion in a slag tap boiler to adjust the ash viscosity and AFT characteristics to meet the design characteristics for the boiler. In this way, stable boiler operation can be maintained while reducing sulfur dioxide emissions. Any iron-bearing bearing material may be added to the combustion process to adjust the ash viscosity characteristics. The iron-bearing material may be, for example, one or more of iron and iron oxide bearing materials such as, for example, iron ore beneficiation tailings, iron ore fines, pelletized iron ore, pelletized blends of coal, other solid fuels including iron-bearing materials, iron-bearing boiler ash, mill scale from steel production, flue dust from blast furnace gas cleaning equipment, and flue dust from sinter plants. Other iron-bearing materials will be readily apparent to those of ordinary skill. The iron present in the iron-bearing materials may be in the form of ferric oxide ($Fe_2O_3$), ferrous oxide (FeO), or neutral iron (Fe), either alone of in combinations, as well as other chemical forms of iron. Typical iron ores that may be used to flux the fuel ash by the method of the present invention are hematite, taconite, and magnetite. Carbon may be present in the iron-bearing materials in the form of, for example, blast furnace flue dust, or carbon may be added to these materials to promote reduction of the iron oxides to more readily flux the fuel ash.

The one or more iron-bearing materials are added to the boiler in a ratio with the fuel to the boiler in order to produce a composite ash and slag chemistry that will resemble the design characteristics of the particular boiler. The iron-bearing materials may be added as furnished from the producer, or may be subject to further processing to optimize their use as fluxes. For example, the particle size distribution of the iron-bearing materials may be adjusted so that a certain fraction will be entrained in the combustion gas, and therefore, may be available to flux slag screen deposits, if necessary. Adjustment of the particle size distribution may be effected through agglomeration of particles or through size reduction of the particles, either alone or in combination to reduce the particle size distribution. Those of ordinary skill will be familiar with those and other methods of altering particle size distribution of solid materials.

Figure 4:
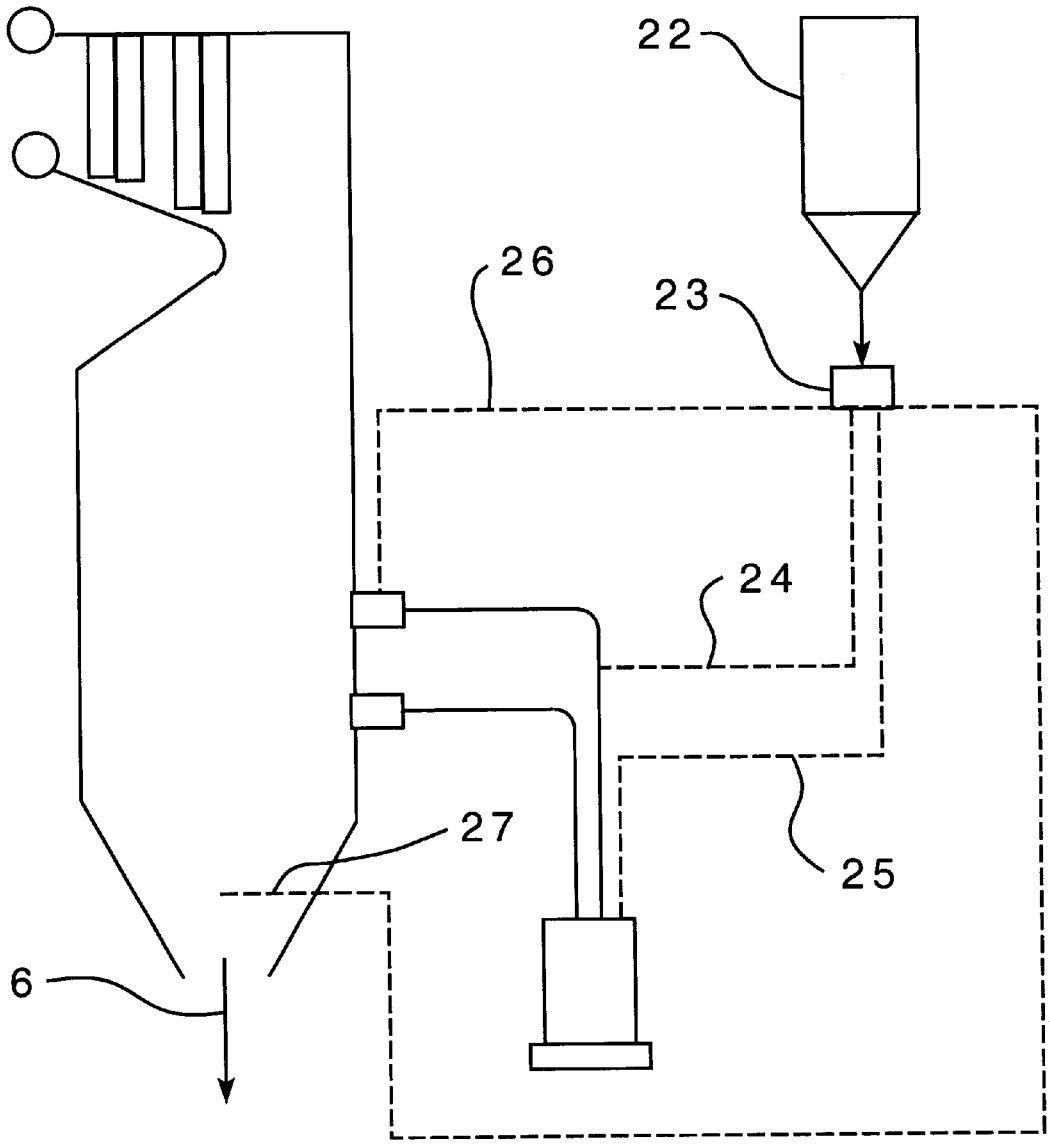
FIG. 4 schematically depicts a pulverized coal slag tap boiler installation and identifies several possible locations for introduction of iron-bearing material into the boiler according to the method of the present invention.
Figure 5:
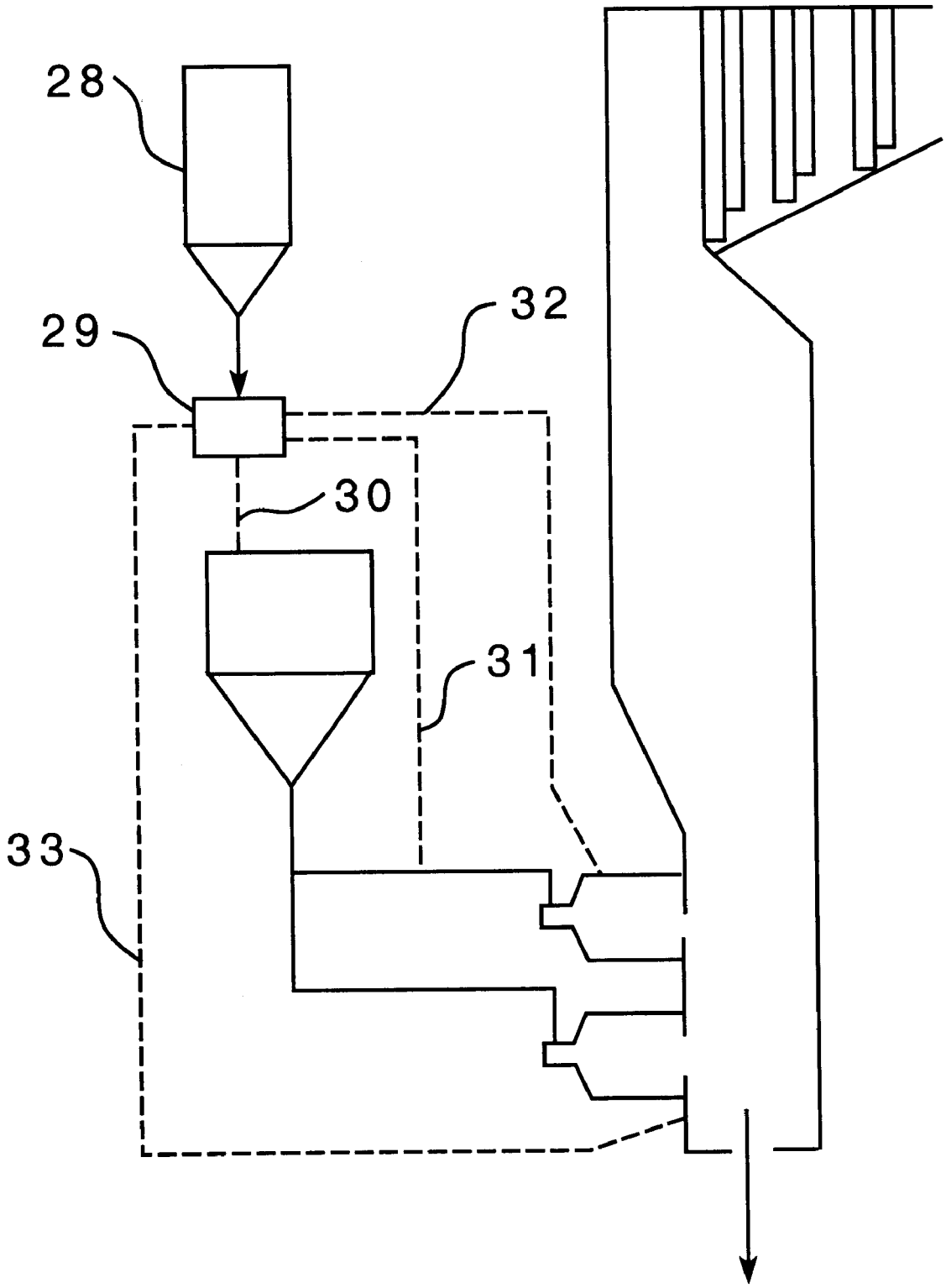
FIG. 5 depicts a cyclone boiler installation and identifies several possible locations for introduction of iron-bearing material into the boiler according to the method of the present invention.

The appropriate methods of introducing the iron-bearing material into the boiler will depend on the specific boiler design, installation, and boiler type. FIG. 4 depicts several locations for introducing iron-bearing material into a slag tap boiler. This figure is meant only as an example and not to limit the method of the present invention. The iron-bearing material may be fed from iron-bearing material storage 22 through transfer system 23 for introduction in slag tap boilers according to the method of the present invention at several locations including, but not limited to, the fuel transfer system 24, pulverizers 25, directly into burners 26, into combustion chamber enclosure 27, for example, through a lance inserted through an existing opening in the combustion chamber 27 enclosure, or at any other location in the system. FIG. 5 depicts several locations for introduction of the iron-bearing material into a cyclone boiler. Possible locations for introducing iron-bearing materials to flux the fuel ash in cyclone boilers include, but are not limited to, at iron-bearing material storage 28, through iron-bearing material transfer system 29, into the fuel storage bunker 30, into the fuel transfer system 31, directly into the cyclone boilers 32, into the combustion enclosure 33, for example, through a lance inserted through an existing opening in the combustion chamber 33 enclosure, or at any other location in the system.

In order to illustrate embodiments of the method of the present invention, Table 1 lists four different coals and typical properties of each coal type, including the composition of the resultant ash, AFT characteristics, and sulfur and iron contents. Fuels 1 and 2 are of a type commonly found in the midwestern United States region. These midwestern coals typical possess low AFT characteristics that render them suitable for use in slag tap boilers. Many slag tap boiler systems, in the United States and elsewhere, were originally designed to use fuels with the ash fusibility characteristics similar to fuels 1 and 2 of Table 1. Table 1 also indicates the United States Geological Survey (USGS) identification numbers for each coal listed.

Fuels 1 and 2 have significantly higher sulfur contents than fuels 3 and 4 listed in Table 1. The use of high sulfur coals may currently be precluded for combustion in many boilers based on current environmental regulations without installation of the equipment necessary to remove or scrub the resultant sulfur dioxide from the combustion gas. Fuels 3 and 4 and similar coals contain significantly lower concentrations of sulfur and may be suitable for use in coal fired boilers without expensive flue gas desulfurization equipment. However, the AFT characteristics of fuels 3 and 4 are above 2800° F. and therefore their use in a slag tap boiler would lead to slag handling problems as previously discussed. thus, fuels 3 and 4 are unsuitable for use in slag tap boiler without suitable flue gas desulfurization equipment. Fuels 3 and 4 are typical of low sulfur content coal which also has high AFT characteristics. Fuels of this type may be rendered suitable for use in slag tap boilers by the method of the present invention. Addition of suitable amounts of iron-bearing material according to the method of the present invention to low sulfur coals with high AFT characteristics will adjust the base-to-acid ratio and ultimately the ash viscosity characteristics to render the low sulfur coals suitable for use in slag tap boilers. The addition of iron-bearing materials to low sulfur coals adjusts the iron content of the slag to more closely resemble that characteristic of the type of fuel represented in Table 1 by fuels 1 and 2.

TABLE 1

Analyses of Selected Fuels

| Fuel | 1 | 2 | 3 | 4 |
|---|---|---|---|---|
| USGS I.D.# | 219409 | 219414 | 195042 | 195040 |
| Seam | Lower Kittanning | Pittsburgh | #2 Gas | #5 Block |
| County | Belmont | Belmont | Logan | Logan |
| State | Ohio | Ohio | West Virginia | West Virginia |
| Wt % Ash | 13.8 | 8.9 | 11.1 | 10.2 |
| Wt % Sulfur | 5.2 | 3.8 | 0.60 | 0.60 |
| Ash Analysis: | | | | |
| Wt % $SiO_2$ | 43.0 | 34.0 | 59.0 | 56.0 |
| Wt % $Al_2O_3$ | 4.8 | 21.0 | 29.0 | 27.0 |
| Wt % CaO | 2.8 | 2.9 | 0.84 | 3.6 |
| Wt % MgO | 0.13 | 0.71 | 0.50 | 0.50 |
| Wt % $Fe_2O_3$ | 44.0 | 32.0 | 2.2 | 2.7 |
| Wt % Fe | 30.6 | 22.2 | 1.53 | 1.88 |
| IDT (° F.) | 1900 | 1980 | 2800+ | 2800+ |
| ST (° F.) | 1990 | 2080 | 2800+ | 2800+ |
| FT (° F.) | 2100 | 2150 | 2800+ | 2800+ |

In Table 2, chemical analyses of several iron-bearing materials are listed. These iron-bearing materials are listed only to provide an example of possible iron-bearing materials that maybe used in the method of the present invention. It is believed that other materials bearing iron may be used to adjust the ash viscosity characteristics according to the present invention, and the method of the present invention is not meant to be limited to the materials listed in Table 2. One of ordinary skill may, without undue experimentation, identify other useful iron-bearing materials. Iron-bearing materials listed in Table 2 include iron ore, taconite pellets, blast furnace flue dust, and blast furnace sludge. All of these materials contain a high concentration of iron, but also have low concentrations of materials that constitute the acidic constituents in fuel ash, for example, silicon or aluminum oxides. As such, addition of these materials to the combustion chamber will have the relative effect of increasing the iron content of the slag produced from the fuel ash significantly over the acidic constituent, resulting in a reduction in AFT characteristics and $T_{250}$. The increase in iron content of slag accompanying the introduction of the iron-bearing materials to the slag will increase the base-to-acid ratio of the slag.

TABLE 2

Iron-bearing Materials

| Number | 1 | 2 | 3 Blast Furnace | 4 Blast Furnace |
|---|---|---|---|---|
| Source | Taconite | Iron Ore | Flue Dust | B.F. Sludge |
| Wt % $SiO_2$ | 7.5 | 10.4 | 6.9 | 6.1 |
| WT % $Al_2O_3$ | 0.64 | 1.5 | 2.5 | 3.0 |
| Wt % CaO | 0.36 | 0.36 | 3.1 | 2.7 |
| Wt % MgO | 0.47 | 0.01 | 0.7 | 0.7 |
| Wt % Fe | 61.1 | 50.4 | 32.2 | 28.6 |
| Wt % C | — | — | 38.5 | 40.8 |

The iron-bearing materials are preferably added to coal with high AFT characteristics in a quantity to adjust the composite slag viscosity characteristics to approximate that of a fuel with lower AFT characteristics for which the boiler was designed to operate. Those of ordinary skill may readily ascertain the necessary feed amount and feed rate of a particular iron-bearing material that must be used with a particular solid fuel. Typically, a coal-fired boiler is designed to operate with a coal from a specific region having certain properties, usually referred to as the "design fuel" of the boiler. There are several characteristics of the design coal that may be approximated in order to determine the quantity of iron-bearing material to add to the high AFT coal. These include but are not limited to the ash viscosity temperature characteristics of the design coal, the base-to-acid ratio of the design coal, and the iron content of the design coal.

An example of the method of the present invention is shown in Table 3. Fuel 2 of Table 3 is the design coal of the slag tap boiler of this example. Fuel 2 is a high sulfur coal with low AFT characteristics. Fuel 3 is a fuel that has high AFT characteristics and would be unsuitable for use in a slag tap boiler designed for fuel 2 without modification of the fuel's AFT characteristics. The base-to-acid ratio of fuels 2 and 3, listed in the Table 3, were calculated according to the equation listed above. In this equation the four sources of iron-bearing material listed in Table 2 will be blended with fuel 3 to adjust the AFT characteristics of the fuel to approximate the AFT characteristics of fuel 2. The blended fuels, fuels 3.1, 3.2, 3.3 and 3.4, have a target base-to-acid ratio of 0.65 to approximate the base-to-acid ratio of fuel 2. This method was used because the base-to-acid ratio of coal may be used to estimate the AFT characteristics and the ash viscosity of the ash slag. The amount of each of the iron-bearing materials required to approximate the design fuel may be determined with simple linear programming means utilizing the base-to-acid ratio equation, the base-to-acid ratio of the design fuel, and the base-to-acid ratio of the fuel to be adjusted. From this method the final ratio of the amount of the iron-bearing material and the fuel to be adjusted may be determined. This iron bearing material/fuel ratio was calculated for the four iron-bearing materials in Table 2 to blend with fuel 3 in Table 3 to approximate the AFT characteristics of fuel 2 in Table 3.

Addition rates required for the iron-bearing material may require further adjustment if additional iron-bearing material is desired to be entrained from the combustion chamber in the combustion gases to flux the slag on the slag screen or is lost in the flyash. It is envisioned that iron-bearing material addition rates as low as 0.50% and as high as 25% or more to the combustion chamber may be required, based on the ash properties of the fuel. Optimization of partitioning of the iron-bearing material to enter the boiler slag rather than the flyash, and research for each installation regarding the minimum base-to-acid ratio required for maintenance of acceptable slag flow properties will determine the final form and addition rate of the iron-bearing material.

TABLE 3

Examples of addition of iron-bearing materials

| Fuel | 2 | 3 | 3.1 | 3.2 | 3.3 | 3.4 |
|---|---|---|---|---|---|---|
| Addition Rates, wt % iron bearing material to fuel input rate. | 0 | 0 | 7.1 | 9.1 | 13.5 | 15.5 |
| Wt % $SiO_2$ | 34.0 | 59.0 | 38.9 | 37.1 | 38.6 | 37.0 |
| Wt % $Al_2O_3$ | 21.0 | 29.0 | 17.9 | 16.6 | 18.3 | 18.2 |
| Wt % CAO | 2.9 | 0.84 | 0.64 | 0.62 | 2.6 | 2.5 |
| Wt % MgO | 0.71 | 0.50 | 0.49 | 0.28 | 0.8 | 0.81 |
| W % Fe | 22.2 | 1.53 | 24.8 | 23.6 | 23.3 | 22.7 |
| base-to-acid ratio | 0.64 | 0.04 | 0.65 | 0.65 | 0.65 | 0.65-- |

Accordingly, the present invention is directed to a method of modifying the operation of certain boiler types so that such boilers may utilize solid fuels otherwise unsuitable for use in the boilers. It is to be understood that the present description illustrates aspects of the invention relevant to a clear understanding of the invention. Certain aspects of the invention that would be apparent to those of ordinary skill in the art and that, therefore, would not facilitate a better understanding of the invention, have not been presented in order to simplify the present description. Although the present invention has been described in connection with certain embodiments, those embodiments should not be considered as limiting the true scope of the present invention. Those of ordinary skill in the art will, upon considering the foregoing description, recognize that modifications and variations of the invention may be employed. The foregoing description and the following claims are intended to cover all such variations and modifications of the invention.

We claim:

1. A method of operating a solid fuel fired boiler, comprising:

introducing a solid fuel into the boiler;

introducing an iron-bearing material into the boiler;

introducing at least one carbon compound along with the iron-bearing material, the at least one carbon compound promoting reduction of iron oxides; and at least partially combusting the solid fuel to produce an ash slag, wherein at least one ash fusion temperature characteristic selected from the group consisting of initial deformation temperature, softening temperature, hemispherical temperature, and fluid temperature less than the same ash fusion temperature characteristic of a second ash slag produced from combustion of the solid fuel alone.

2. The method of claim 1, wherein the solid fuel comprises coal.

3. The method of claim 1, wherein the iron-bearing material is added to the solid fuel before introducing the solid fuel and the iron-bearing material into the boiler.

4. The method of claim 1, wherein the coal has a sulfur content less than 2% weight.

5. A method of operating a solid fuel fired boiler, comprising:

introducing a solid fuel into a slag tap boiler;

introducing an iron-bearing material into the slag tap boiler, wherein the iron bearing material is at least one of iron ore beneficiation tailings, iron ore fines, pelletized blends of coal and iron-bearing material, pelletized solid fuel containing iron-bearing compounds, iron-bearing boiler ash, mill scale from steel production, dust from blast furnace gas cleaning equipment, and flue dust from sinter plants; and at least partially combusting the solid fuel to produce an ash slag, wherein at least a portion of the iron bearing material fluxes the ash slag to produce a composite ash slag having at least one ash fusion temperature characteristic selected from the group consisting of initial deformation temperature, softening temperature, hemispherical temperature, and fluid temperature less than the same ash fusion temperature characteristic of the ash slag produced from combustion of the solid fuel alone.

6. The method of claim 5, wherein the solid fuel comprises coal.

7. The method of claim 5, wherein the composite ash slag has at least one ash fusion temperature characteristic selected from the group consisting of initial deformation temperature, softening temperature, hemispherical temperature, and fluid temperature less than 2600° F.

8. The method of claim 5, wherein the slag tap boiler is for at least one of steam production and electricity generation.

9. The method of claim 5, wherein the slag tap boiler is a cyclone boiler.

10. The method of claim 5, wherein the composite ash slag has a viscosity such that the composite ash slag flows from the slag tap boiler.

11. The method of claim 5, further comprising pulverizing the solid fuel prior to introducing the solid fuel into the slag tap boiler.

12. The method of claim 5, wherein the iron-bearing material is at least one material selected from the group consisting of iron ore beneficiation tailings, iron ore fines, pelletized iron ore, pelletized solid fuels containing at least one iron-bearing compound, iron-bearing boiler ash, mill scale from steel production, flue dust from blast furnace gas cleaning equipment, and flue dust from sinter plants.

13. The method of claim 5, wherein the iron-bearing material comprises at least one of ferric oxide, ferrous oxide, and neutral iron.

14. The method of claim 5, wherein the iron-bearing material comprises at least one of hematite, taconite, and magnetite.

15. The method of claim 5, wherein the iron-bearing material comprises at least one carbon compound.

16. The method of claim 5, further comprising introducing at least one carbon compound along with the iron-bearing material, the at least one carbon compound promoting reduction of iron oxides.

17. The method of claim 5, wherein the slag tap boiler comprises:

a pulverizer, wherein the solid fuel is fed to the pulverizer;

a burner;

a fuel transfer system communicating with the pulverizer and the burner; and a combustion chamber comprising an enclosure at least partially surrounding the burner.

18. The method of claim 9, wherein the cyclone boiler comprises:

a fuel storage bunker;

a cyclone burner;

a fuel transfer system communicating with the fuel storage bunker and the cyclone burner; and a combustion chamber comprising an enclosure at least partially surrounding the burners.

19. The method of claim 5, wherein the concentration of iron-bearing material to solid fuel is from 1 to 25 weight percent of the total of the iron-bearing material and the solid fuel introduced into the slag tap boiler.

20. The method of claim 5, wherein the composite ash slag has a total iron concentration of 15 to 30 weight percent.

21. The method of claim 5, wherein the iron-bearing material is added to the solid fuel before introducing the solid fuel and the iron-bearing material into the slag tap boiler.

22. The method of claim 5, further comprising:

adjusting the particle size distribution of the iron-bearing material.

23. A method of operating a solid fuel fired boiler, comprising:

introducing a solid fuel into a cyclone boiler, wherein the cyclone boiler comprise:

a fuel storage bunker, a cyclone burner, a fuel transfer system communicating with the fuel storage bunker and the cyclone burner, and a combustion chamber comprising an enclosure at least partially surrounding the burner, introducing an iron-bearing material into at least one of the fuel storage bunker, the fuel transfer system, the cyclone burner, and the combustion chamber, and at least partially combusting the solid fuel to produce an ash slag, wherein at least one ash fusion temperature characteristic selected from the group consisting of initial deformation temperature, softening temperature, hemispherical temperature, and fluid temperature is less than the same ash fusion temperature characteristics of a second ash slag produced from combustion of the solid fuel alone.

24. The method of claim 23, wherein the iron-bearing material is introduced into the combustion chamber through a lance inserted through an opening in the combustion chamber enclosure.

25. The method of claim 23, wherein the solid fuel is a coal having a sulfur content less than 2% by weight.

26. The method of claim 6, wherein the coal comprises a sulfur content less than 2.0% by weight.

* * * * *